US011480181B2

(12) United States Patent
Stoll et al.

(10) Patent No.: US 11,480,181 B2
(45) Date of Patent: Oct. 25, 2022

(54) VACUUM SYSTEM WITH A MULTI-STAGE AND MULTI-INLET VACUUM PUMP WITH A DIRECTIONAL ELEMENT SEPARATING PUMP STAGES

(71) Applicants: PFEIFFER VACUUM GMBH, Asslar (DE); AGILENT TECHNOLOGIES, INC., Santa Clara, CA (US)

(72) Inventors: Tobias Stoll, Hohenaar (DE); Michael Schweighoefer, Schoeffengrund (DE); Jan Hoffmann, Gruenberg (DE); James L. Bertsch, Palo Alto, CA (US)

(73) Assignees: PFEIFFER VACUUM GMBH, Asslar (DE); AGILENT TECHNOLOGIES, INC., Santa Clara, CA (US)

( * ) Notice: Subject to any disclaimer, the term of this patent is extended or adjusted under 35 U.S.C. 154(b) by 42 days.

(21) Appl. No.: 16/922,045

(22) Filed: Jul. 7, 2020

(65) Prior Publication Data

US 2021/0018004 A1 Jan. 21, 2021

(30) Foreign Application Priority Data

Jul. 15, 2019 (EP) ..... 19186289

(51) Int. Cl.
*F04D 19/04* (2006.01)
*F04D 19/02* (2006.01)

(52) U.S. Cl.
CPC ..... *F04D 19/042* (2013.01); *F04D 19/022* (2013.01); *F04D 19/028* (2013.01)

(58) Field of Classification Search
USPC ..... 415/1, 90, 143; 417/423.4, 248
See application file for complete search history.

(56) References Cited

U.S. PATENT DOCUMENTS 7,011,491 B2 3/2006 Englander
7,762,763 B2 * 7/2010 Stones ..... F04D 19/046 416/198 A (Continued)

FOREIGN PATENT DOCUMENTS

EP 3085963 A1 10/2016
JP H06-24918 A 6/1994

OTHER PUBLICATIONS

EP Extended Search Report from Corresponding EP Application No. 19186289.5-1007; dated Jan. 16, 2020.

*Primary Examiner* — Peter J Bertheaud
*Assistant Examiner* — Geoffrey S Lee
(74) *Attorney, Agent, or Firm* — Oblon, McClelland, Maier & Neustadt, L.L.P.

(57) ABSTRACT

The invention relates to a vacuum system, comprising a vacuum pump, preferably turbomolecular pump, and at least one vacuum chamber, wherein the vacuum pump comprises: at least a first and a second inlet and a common outlet; at least a first and a second pumping stage, each pumping stage comprising at least one rotor element being arranged on a common rotor shaft, wherein the first inlet is connected to an upstream end of the first pumping stage and the second inlet is connected to an upstream end of the second pumping stage; a direction element for preventing a gas flow from a downstream end of the first pumping stage to the second inlet; a conduit having a conduit inlet and a conduit outlet, wherein the conduit inlet is connected to the downstream end of the first pumping stage and the conduit outlet is connected to a location downstream of the second pumping stage; wherein the first inlet and the second inlet of the pump are connected to the same vacuum chamber.

18 Claims, 4 Drawing Sheets

(56) References Cited

U.S. PATENT DOCUMENTS

| | | | | |
|---|---|---|---|---|
| 8,481,923 | B1 * | 7/2013 | Kitamoto | F04D 19/04 250/281 |
| 2004/0013514 | A1 * | 1/2004 | Englander | F04D 17/168 415/143 |
| 2007/0020116 | A1 * | 1/2007 | Stones | F04D 19/046 417/201 |
| 2008/0063541 | A1 * | 3/2008 | Stones | F04D 19/04 417/250 |
| 2008/0193303 | A1 * | 8/2008 | Stones | F04D 19/046 417/251 |

* cited by examiner

VACUUM SYSTEM WITH A MULTI-STAGE AND MULTI-INLET VACUUM PUMP WITH A DIRECTIONAL ELEMENT SEPARATING PUMP STAGES

CROSS-REFERENCE TO RELATED APPLICATION

This application claims priority to European application no. EP 19186289.5, filed Jul. 15, 2019, the content of which is incorporated by reference herein in its entirety.

FIELD OF INVENTION

The present invention is directed to a vacuum system, comprising a vacuum pump, preferably a turbomolecular pump, and at least one vacuum chamber, wherein the vacuum pump comprises: at least a first and a second inlet and a common outlet; at least a first and a second pumping stage, each pumping stage comprising at least one rotor element being arranged on a common rotor shaft, wherein the first inlet is connected to an upstream end of the first pumping stage and the second inlet is connected to an upstream end of the second pumping stage; a direction element for preventing a gas flow from a downstream end of the first pumping stage to the second inlet; a conduit having a conduit inlet and a conduit outlet, wherein the conduit inlet is connected to the downstream end of the first pumping stage and the conduit outlet is connected to a location downstream of the second pumping stage.

BACKGROUND OF PRIOR ART

Turbomolecular pumps, for example, began with a single main inlet where the gas was pumped in opposite directions by two opposingly arranged sets of rotor elements on one common rotor to increasingly higher pressures into the viscous pressure range. Then pipes would connect the outlets to another pump which continues the pressurization to atmospheric pressure. This effectively is two molecular pumps pointing in opposite directions on a common shaft and a third viscous pump to back them. The obvious disadvantages are cost and the challenges of having a very long rotor shaft which has rotational dynamics problems at high speed. Smaller and cheaper pumps were soon developed which practically cut the pump in half and used various tricks like magnetic bearings or cantilevered shafts to hide the bearing from the high vacuum region. Later, horizontal split-flow pumps were created which had multiple side inlets. These have huge advantages for applications where there is a significant gas load into the system being pumped.

Often, the system can be designed such that the pump is oriented parallel to the chamber system so that gas is removed in successive stages, thereby minimizing the amount of pumping speed required and the power required to compress the gas. This can, for example, be the case in systems for liquid chromatography mass spectrometry, hereinafter abbreviated as LC/MS. However, in many cases, including LC/MS, the ultimate performance of the system is limited by the pumping speed of the lowest pressure stage. In the case of LC/MS, there must be collision cell gas introduced after the first mass filter to create fragmentation and to facilitate collisional cooling of the analyte ions for introduction into the second mass filter, be it a Quad, TOF, or Trap. Thus, the system performance is limited by the lowest pressure vacuum inlet pumping speed. To improve that pumping speed, it is undesirable to increase the rotational speed of the pump, because it is limited by the creep performance of the material used, such as 7000 series aluminum alloys. The diameter of the rotors may be increased. However, this adds to costs and increases the challenges of rotor dynamics and bearing design. Also, significantly increasing the diameter makes the creep worse, forcing you to decrease the rotational speed. Although much larger pumping speeds can be achieved by using larger pumps, the systems need to be sized accordingly and the costs of the larger pumps increase dramatically.

Thus, it has been the case for several decades in the industry that cost increases with the diameter of the rotor, and the primary inlet pumping speed is limited by that diameter.

As a further example illustrating the background of the invention, a very common application of split-flow turbomolecular pumps is mass spectrometry. There are a wide variety of designs with different requirements for vacuum technology. A special type includes a TOF detector (TOF=Time-Of-Flight) to which the HV port of the split-flow pump is connected. The special feature of this detector is the long travel distance of the ions. As far as possible, there should be no collisions with foreign atoms, as otherwise the ion to be analyzed will be lost. For this reason, a low pressure, preferably in the range of 5E-9 hPa and lower, is required in order to achieve the largest possible mean free path length of the ions. Since gas loads have to be expected in the detector region, such as from leakage, desorption and/or a mass spectrometry orifice, a high pumping speed is desirable to reach the target pressure quickly.

SUMMARY OF INVENTION

It is an object of the invention to improve the pumping speed for a vacuum chamber, in particular essentially without or with small increase in costs and/or size.

This object can be achieved by a vacuum system as defined in Claim 1, in particular by the first inlet and the second inlet of the pump being connected to the same vacuum chamber.

This leads to a significantly high pumping speed and, thus, to a notably low pressure in the vacuum chamber. However, this increase in pumping speed can be achieved without increasing rotor diameter and rotation speed. In an exemplary prototype, an increase of 70% in pumping speed has been measured, wherein rotor diameter and rotation speed were maintained.

Rotor length might need to be increased, e.g. in order to implement the second inlet, the second pumping stage and/or the direction element. However, increase in length is less problematic than increase in rotor diameter with respect to costs, space and dynamic boundaries. For example, an increase in rotor length essentially does not affect the centrifugal forces at the rotor elements, whereas an increase in rotor diameter immediately increases the centrifugal forces, especially in turbomolecular pumps, which generally work at extremely high rotational speeds. Thus, even if an increase in rotor length may be necessary to implement the invention, costs do not need to increase much, in particular because the same set of bearings and support construction can be used as is an exemplary pump of the prior art.

In particular, the conduit essentially bypasses the second pumping stage and/or the second inlet. Thus, the first and the second pumping stages as well as the first and second inlets are essentially independent from each other, in particular such that the pumping speeds of the first and second pumping stage are added in order to achieve a high common pumping speed for the vacuum chamber connected thereto.

The direction element essentially provides for the gas pumped through the first pumping stage to be directed from the downstream end of the first pumping stage to the conduit inlet and to be prevented, at least essentially, from flowing to the second inlet and the upstream end of the second pumping stage. The direction element may, for example, do so by blocking such gas flow between the downstream end of the second pumping stage and the first inlet, in particular without effecting a pumping activity itself. Additionally or alternatively, the direction element may, for example, itself comprise pumping means adapted to effect a pumping action from the second inlet to the downstream end of the first pumping stage and the conduit inlet.

According to the invention, both the first inlet and the second inlet are connected to the same, i.e. one, vacuum chamber. That means that in the chamber between the first and the second inlet there must not be any structure which separates the regions to which the inlets are connected such that these regions must be viewed as separate chambers. In particular, the inlets should not be separated in the chamber by a structure of low conductance, such as a wall, even if this wall comprises a small orifice.

A preferred application of the present invention is a mass spectrometry system. Such a system usually comprises a plurality of vacuum chambers, wherein a first vacuum chamber comprises a small fluid connection to a neighboring, second chamber through an orifice. However, the vacuum levels, i.e. the absolute pressures, in the two chambers are different inter alia due to the small size of the orifice. It allows to maintain the pressure difference which is built up by one or more vacuum pumps.

Two chambers having a fluid connection must, thus, be viewed as separate chambers if the fluid connection comprises only a low conductance or if the system comprises a high pumping speed as a ratio to the conductance. A single chamber, in contrast, should, in particular, comprise an essentially homogeneous pressure and/or a high conductance between the first and second inlets.

Preferably, a conductance L is defined in the chamber between the first and the second inlet, wherein the pumping speed at both inlets together is a combined pumping speed S, and wherein a ratio $S/L<300$, preferably $<100$, preferably $<50$, preferably $<10$.

Each of the pumping stages may preferably be a molecular pumping stage, in particular turbomolecular pumping stage or molecular drag pumping stage, such as a Holweck-pumping stage. The common outlet may generally be connected to a backing pump. In the case of a turbomolecular pumping stage, the first, second and/or further pumping stages may preferably comprise two or three turbo rotor elements and/or turbo stator elements. However, one or more turbo rotor and/or stator elements are also possible. It is generally preferred to have one turbo stator element follow each turbo rotor element.

In particular, both pumping stages may define respective gas streams which are separate from each other and flow in parallel mode upstream of the location to which the conduit outlet is connected.

The pump and/or system may comprise additional pumping stages upstream or downstream of any of the first and second pumping stages. In particular, the pump may comprise a third pumping stage, preferably wherein the third pumping stage comprises an upstream end which is connected to the conduit outlet, the downstream end of the second pumping stage, and/or a third inlet. Preferably, the third pumping stage is adapted and/or arranged to receive the pumped gas from the first and the second pumping stages and pump it further to the common outlet, optionally through further pumping stages. The third or any further pumping stage may comprise at least one rotor element arranged on the common rotor shaft.

In the present context, the term "arranged on" is to be understood to include "attached to" or "fixed to".

In an embodiment, the pump comprises a third inlet connected to the upstream end of the or a third pumping stage, the conduit outlet and/or the downstream end of the second pumping stage, wherein the third inlet is connected to a second vacuum chamber. Thereby, a different vacuum level in the second chamber can be achieved, which can be desirable in specific applications.

In general, the idea of the invention to make the first and second pumping stages independent of each other and connect them to the same chamber may as well be applied to further inlets and pumping stages. Thus, the pump may comprise at least one further inlet connected to the same chamber as the first and second inlets and connected to a further independent pumping stage. In particular, the pump may further comprise at least one further pumping stage having a rotor element on the common rotor shaft and having an upstream end connected to the respective further inlet, wherein at least one further conduit is provided connecting the downstream end of the respective further pumping stage with a or the location downstream of the second pumping stage, be it directly or via the first conduit, and wherein a further direction element is provided directing the gas flow from the downstream end of the respective further pumping stage to the inlet of the further conduit and/or preventing a gas flow from a downstream end of the respective further pumping stage to a neighboring inlet. In particular, three or more inlets may be connected to the same chamber, if the inlets are connected to independent pumping stages as outlined above. Note that the further inlets and pumping stages as described in this paragraph shall not be confused with the third and fourth inlets and pumping stages as referred to in the two preceding paragraphs and in the description of the appended drawings, as there the third and fourth inlets are connected to separate chambers.

According to an embodiment, the direction element comprises at least one blocking wall. This allows a simple construction and a small occupation of axial space, i.e. the rotor length does not need to be increased much. In particular, the blocking wall does not provide a pumping action. It should be noted that the blocking wall does not need to perfectly seal the downstream end of the first pumping stage from the second inlet, as the rotor still needs to rotate with high speed with respect to a housing. The blocking wall preferably leaves a gap between rotating and static parts, which essentially corresponds to the maximum deflection of the rotor shaft in the area of the blocking wall. The gap is, thus, preferably radially small, in particular as small as possible within the allowed tolerances and rotor deflection.

In general, the blocking wall may surround the rotor shaft. In an example, the blocking wall is round or disc shaped or comprises a disc. This further simplifies the construction. In particular, the blocking wall may comprise two half discs assembled to one disc.

The direction element may comprise a static blocking wall and/or a blocking wall, which is arranged on the rotor or rotor shaft. A static blocking wall does not rotate with the rotor, while a blocking wall arranged on or attached to the rotor or rotor shaft does. All this improves blocking performance. A static blocking wall may, for example, be fixed within the pump, in particular at an inner housing surface, e.g. by means of spacer rings.

Preferably, the pump comprises a blocking wall on the rotor or rotor shaft and a static blocking wall that are arranged in close axial proximity to each other. In this embodiment, a leakage of gas from the downstream end of the first pumping stage towards a neighboring stage or inlet would not only have to make it across a radial gap defined between the static blocking wall and the rotor, but also across an axial gap between the static blocking wall and the one on the rotor shaft. Thereby, the sealing length, i.e. the length of the path which the gas has to flow along through the narrow gap, is significantly increased, and this is achieved by simple means. Close axial proximity preferably means an axial distance of at most 8 mm, further preferably at most 5 mm, further preferably at most 3 mm, further preferably at most 1 mm.

The direction element may, for example, define a gap between a rotating part and a static part, wherein the gap may preferably be a radial and/or axial gap. The gap can preferably comprise an elongate extension and/or oblong extension or cross-section along the rotor axis, in particular an elongate or oblong axial extension of a radial gap and/or an elongate or oblong radial extension of an axial gap. An angled and/or conical gap may also be possible. The elongate or oblong gap is a further advantageous approach to providing a long sealing length and can be achieved with simple means, such as a sleeve, a snout, or the like. Preferably, an elongate axial extension of a radial gap has a length of at least 2 mm, in particular at least 4 mm, in particular at least 8 mm.

In a further embodiment, the direction element comprises a reverse pumping stage effecting a gas flow from the second inlet to the conduit inlet and/or to the downstream end of the first pumping stage. This prevents a gas flow from the downstream end of the first pumping stage to the second inlet quite effectively, as it not only seals the two locations from each other but also provides for a pumping action in the opposite direction. In general, this embodiment may be combined with a blocking wall as described above. In particular, a blocking wall may define a radial gap, wherein the radial gap is provided with active pumping means, such as molecular drag pumping means, such pumping means comprising a reverse pumping stage.

A reverse pumping stage may be simple to implement if, for example, the reverse pumping stage comprises a rotor element which is arranged on the common rotor shaft. Generally, the reverse pumping stage may comprise a molecular pumping stage, e.g. a turbomolecular pumping stage or molecular drag pumping stage.

According to an embodiment, the reverse pumping stage comprises a pumping direction which is opposite a pumping direction of the first and/or second pumping stage. In particular, the pumping directions are geometrically opposite and/or opposite but essentially parallel to the rotor axis. In general, the first and second pumping stages may preferably comprise a common geometrical pumping direction, which preferably may be parallel to the rotor shaft and/or directed to the common outlet.

The conduit may, for example, be formed in a housing of the vacuum pump, in a separate rigid block, preferably attached to the housing, and/or by a tube or a hose. The conduit may be formed in or by a flexible part, such as a flexible tube or a rigid part, such as a milled and/or extruded metal part. There may be more than one conduit provided. In particular, the conductance between the downstream end of the first pumping stage and the location downstream of the second pumping stage may be increased by providing a plurality of conduits. Generally, the one or more conduits may be arranged at least partly on at least one side of the pump, which is free from a vacuum chamber, in particular an opposite side with respect to the rotor. The at least one conduit may be arranged in a corner of a generally rectangular cross-section of a pump housing, which preferably may be an extruded housing. The conduit or the conduits may preferably comprise a molecular conductance of at least 10 L/s.

In a further advantageous embodiment, a rotating element arranged on the rotor or rotor shaft, such as a rotor element of the first pumping stage and/or a blocking wall arranged on the rotor, and the conduit inlet are arranged such that the conduit inlet is open to a radial end of the rotating element. This improves pumping performance at the conduit inlet. The rotating element gives at least some of the gas molecules a generally radial direction and these gas molecules travel into the open conduit inlet. Thus, the chance for a respective gas molecule to enter and proceed down the conduit is improved. The term "rotating element" refers to any element of the pump that rotates with the rotor shaft during operation of the pump. The term "rotor element" refers to an element which actively pumps gas upon rotation of the rotor shaft. A rotor element may for example be a turbo rotor disc comprising a plurality of rotor blades. Thus, a rotor element is an optional embodiment of a rotating element. Another type of rotating element is described herein as a blocking wall arranged on the rotor shaft. It is to be understood that in order to achieve the described benefit, the rotating element does not necessarily need to be a rotor element. Rather, the benefit is achieved, because the conduit inlet essentially collects the molecules that desorb from the radial end of the rotating element, be it a blocking wall, a rotor element, or any rotating element. In some embodiments, the conduit inlet directly faces the radial end of the rotating element and/or is arranged at the same axial position of the radial end.

It may be further advantageous to provide an angled surface at the conduit inlet and/or conduit outlet. Such an angled surface may direct the gas molecule in a preferred direction, e.g. down the conduit and towards the conduit outlet, thus further improving the pumping speed.

In a further embodiment, the vacuum pump comprises at least two first pumping stages and at least two first inlets corresponding respectively thereto, the downstream ends of all first pumping stages being connected to a location downstream of the second pumping stage and being separated from the second inlet and/or the first inlet of a neighboring first pumping stage, in particular by means of a respective direction element. All first inlets may preferably be connected to the same vacuum chamber as the second inlet. This improves the pumping speed applied to that chamber even further. The downstream ends of the first pumping stages may be connected to a common conduit or may comprise individual conduits. Generally, each first pumping stage may be embodied as described herein with respect to only one first pumping stage. In this regard, the first pumping stages do not need to be but may be identical.

The advantages of the invention are particularly prominent, when the vacuum chamber is part of a mass spectrometry and/or chromatography system. Such a system can make advantageous use of the high pumping speed of the invention.

The object of the invention is further achieved by using a vacuum pump, preferably turbomolecular pump, to evacuate at least one vacuum chamber, according to Claim 16.

Although the dependent Claims may refer back to only one Claim for formal reasons, it is to be understood that the embodiments defined in these dependent Claims may also be advantageously combined with the embodiments of the other dependent Claims.

BRIEF DESCRIPTION OF THE DRAWINGS

In the following, the invention is described in more detail with reference to some exemplary embodiments, such as shown in the schematic drawings.

DETAILED DESCRIPTION OF THE INVENTION

Figure 1:
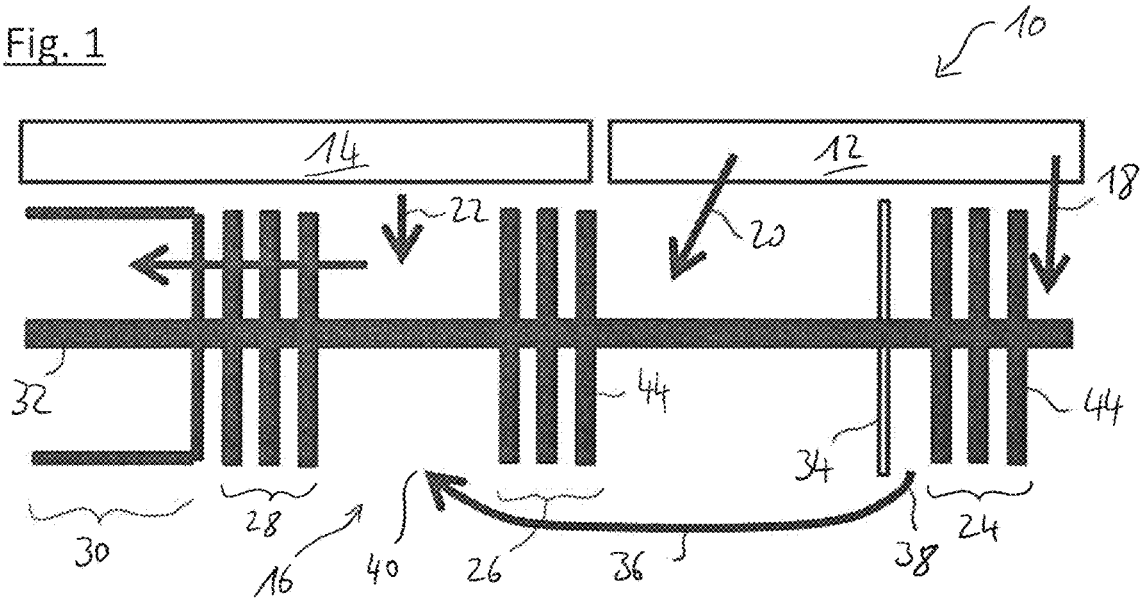
FIG. 1 shows a vacuum system according to the invention.

In FIG. 1, a vacuum system 10 in accordance with the invention is shown. The vacuum system 10 comprises two vacuum chambers, a first vacuum chamber 12 and a second vacuum chamber 14. The vacuum chambers 12, 14 are connected to respective inlets of a vacuum pump 16.

In particular, the pump comprises a first inlet 18 and a second inlet 20, both connected to the same vacuum chamber, i.e. the first vacuum chamber 12. The vacuum pump 16 further comprises a third inlet 22 connected to the second vacuum chamber 14. The inlets 18, 20, 22 are indicated as respective arrows representing a gas stream during pumping action.

The vacuum pump 16 is, in this example, a turbomolecular and split-flow pump and comprises a first pumping stage 24, a second pumping stage 26, a third pumping stage 28 and a fourth pumping stage 30, wherein each pumping stage comprises at least one rotor element 44, three in this embodiment, arranged on a common rotor shaft 32. The rotor shaft 32 forms a rotor of the pump 16. During operation of the pump 16, the rotor shaft 32 rotates at high speed about its longitudinal axis or rotor axis. The rotor elements 44 rotate together with the rotor shaft 32 and cause a pumping effect from the inlets 18, 20, 22 to the common outlet, in the drawings always from right to left (not true for the direction elements and reverse pumping stages as described below).

The first, second and third pumping stages 24, 26 and 28 are turbomolecular pumping stages indicated as three vertical lines each representing a pair of turbo-molecular rotor and stator elements. In this embodiment, each of the pumping stages 24, 26, and 28 comprises three such pairs of turbomolecular rotor and stator elements. However, other numbers and arrangements of turbomolecular rotor and stator elements are possible.

The fourth pumping stage is a molecular drag pumping stage and, in particular, a Holweck pumping stage.

All pumping stages 24, 26, 28 and 30 effect a pumping action in the same direction, which is parallel to the rotor shaft 32, in FIG. 1 from right to left. All gas coming from the vacuum chambers 12 and 14 is pumped to a common outlet, which is not shown but is located downstream of the fourth pumping stage.

The vacuum pump 16 further comprises a direction element, embodied here as a blocking wall 34. The blocking wall 34 prevents gas from flowing from a downstream and of the first pumping stage 24 to the second inlet 20 and an upstream end of the second pumping stage 26.

There is further provided a conduit 36 having a conduit inlet 38 connected to the downstream end of the first pumping stage 24 and a conduit outlet 40 connected to a location downstream the second pumping stage 26, and, in the present case, connected to an upstream end of the third pumping stage 28.

The conduit 36 bypasses the inlet 20 and the second pumping stage 26. It may, for example, be formed in a housing of the vacuum pump, a separate block, and/or a tube or hose.

As can be seen in FIG. 1, the first and second pumping stages 24 and 26 are essentially arranged in parallel mode, wherein respective gas streams through the first and second pumping stages 24 and 26 are united at the location downstream the second pumping stage 26 to which the conduit outlet 40 is connected. In the present case, the same location is connected to the third inlet 22 and the upstream end of the third pumping stage 28.

As will be understood, the pressure in the second vacuum chamber 14 will be higher than the pressure in the first vacuum chamber 12. The vacuum chambers 12 and 14 may be connected to each other by means of a small orifice allowing a limited gas stream from the second vacuum chamber 14 to the first vacuum chamber 12.

Figure 2:
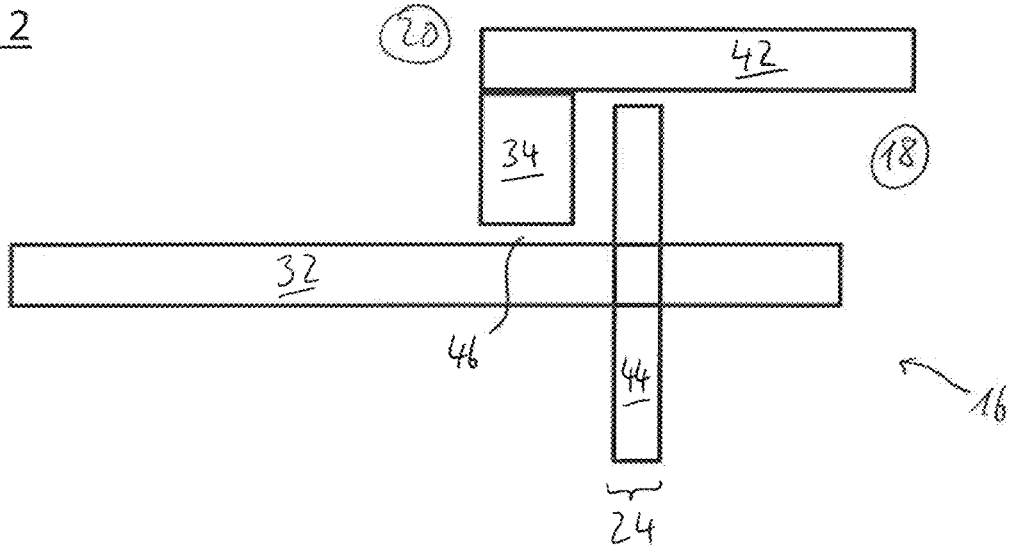
FIG. 2 depicts a vacuum pump with a direction element embodied as a blocking wall according to the invention.

In FIG. 2, a vacuum pump 16 in accordance with the invention is depicted schematically and in part. The vacuum pump 16 comprises a housing 42, in which a rotor is arranged, the rotor comprising a rotor shaft 32 and at least one pair of turbo rotor and stator elements 44. The rotor further comprises at least one second pumping stage, not shown here. The housing 42 defines a first inlet 18 and a second inlet 20. A downstream end of the first pumping stage 24 is essentially sealed from the inlet 20 by means of a blocking wall 34. The blocking wall 34 surrounds the rotor 32, although in FIG. 2 only an upper half of the blocking wall 34 is shown.

The blocking wall 34 is a static blocking wall as it is fixed to the housing 42. It comprises an axial bore, through which the rotor shaft 32 extends. Between the rotor shaft 32 and the blocking wall 34 there is provided a radial gap 46 circumferentially extending about the rotor shaft 32. The radial gap 46 provides for a radial clearance for allowing radial deflection of the rotor shaft 32, as can occur during pumping operation. Essentially, the radial gap 46 corresponds to the maximum radial deflection of the rotor shaft 32 including security tolerances.

However, FIG. 2 is not to scale and the radial gap 46 is small, for example in the domain of some tenth of a millimeter. Thus, the radial gap provides a rather high resistance for the gas to flow from the downstream end of the first pumping stage 24 to the second inlet 20.

The conduit 36, not shown in FIG. 2, preferably comprises a resistance, which is much lower than the resistance of the radial gap. Thus, the conduit 36 preferably comprises a high conductance, whereas the radial gap 46 preferably comprises a low conductance.

Figure 3:
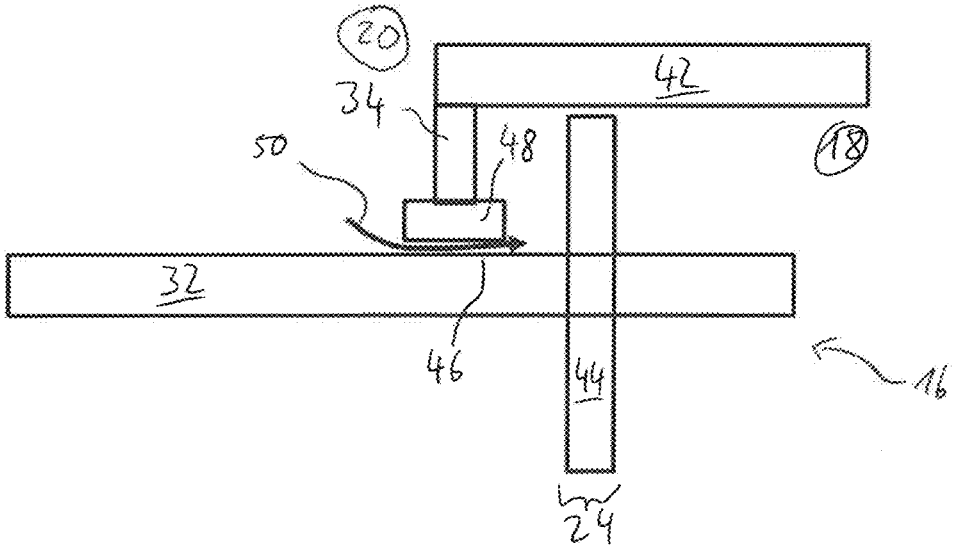
FIG. 3 shows a further vacuum pump with a blocking wall.

Another embodiment is depicted in schematic FIG. 3. In this embodiment, the direction element also comprises a blocking wall 34 fixed to the housing 42, in particular to an inner surface thereof. The direction element further comprises a sleeve 48 defining the radial gap 46 and providing for an elongate axial extension thereof. This elongate axial extension of the radial gap 46 provides for a long sealing length and, thus, for an advantageous sealing and direction effect.

At least one of the opposing surfaces defining the radial gap 46, i.e. at least one of the sleeve 48 and the rotor shaft 32, may comprise an active pump structure, such as a molecular drag pump structure and/or Holweck structure. A gas stream 50 effected by such a pump structure is indicated as an arrow representing a resulting gas stream and leading from the first inlet 20 to the downstream end of the first pumping stage 24. Thus, the pumping direction of the pump structure is directed opposite the one of the first pumping stage 24. Hence, the pump structure acts as a reverse pumping stage.

Such a pump structure may also be implemented at an inner surface of the blocking wall 34 facing the rotor 32 as shown in FIG. 2 and/or opposing surfaces between blocking wall 52 and housing 42, as will be described in more detail with respect to FIG. 4.

Figure 4:
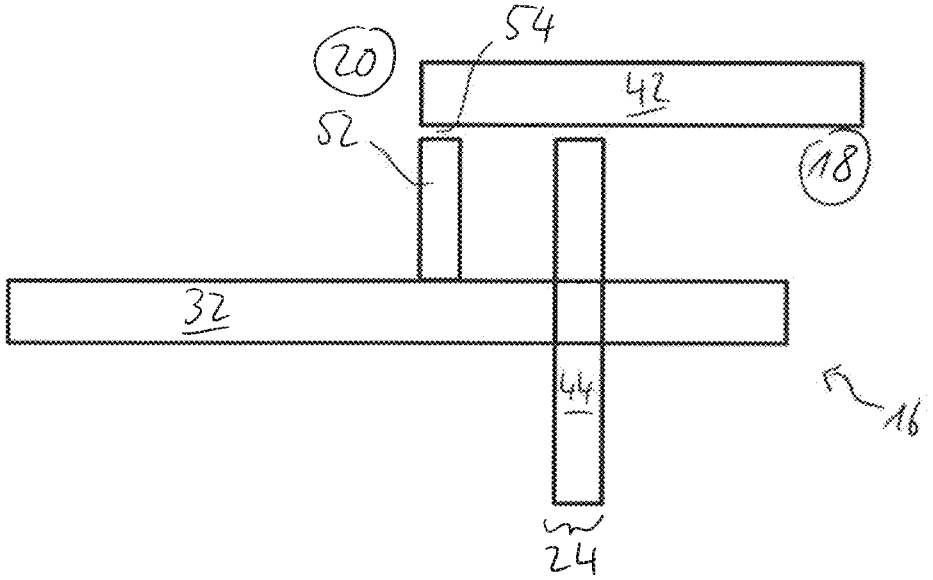
FIG. 4 shows another vacuum pump with a blocking wall.

In FIG. 4, a further embodiment is shown, wherein the direction element comprises a blocking wall 52, which is arranged on the rotor shaft 32. Thus, the blocking wall 52 rotates together with the rotor shaft 32 and the rotor elements 44 of the respective pumping stages. In this embodiment, a radial gap 54 is defined between the blocking wall 52 and a static element of the pump 16, i.e. the housing 42. The radial gap 54 may, as well, comprise an elongate axial extension and/or a pump structure at least at one of its opposing surfaces, i.e. at least at the inner surface of the housing 42 or the outer surface of the blocking wall 52.

Figure 5:
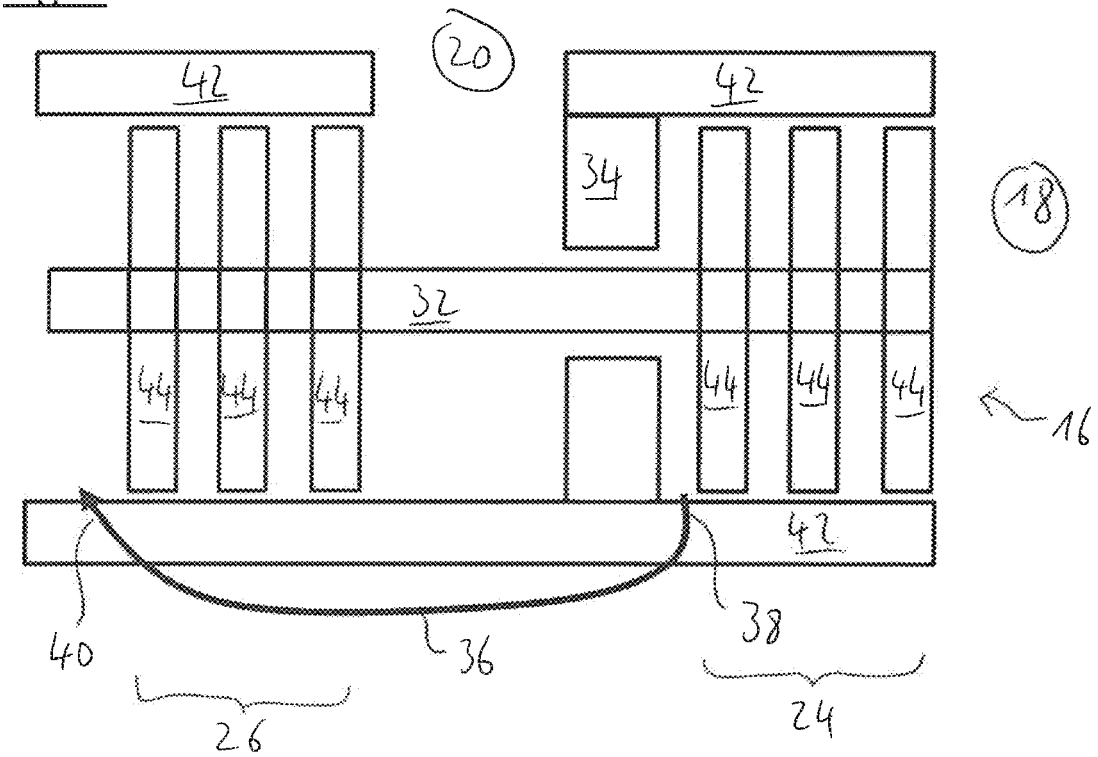
FIG. 5 shows a vacuum pump for a vacuum system in accordance with the invention.

FIG. 5 is a more complete depiction of the embodiment of FIG. 2 with respect to the interior of the pump 16. Also, a conduit 36 is indicated as a corresponding arrow representing a gas stream from the downstream end of the first pumping stage 24 to a location downstream the second pumping stage 26. As can be seen here more clearly, the blocking wall 34 surrounds the rotor shaft 32, wherein the rotor shaft 32 extends through an axial bore of the blocking wall 34.

Figure 6:
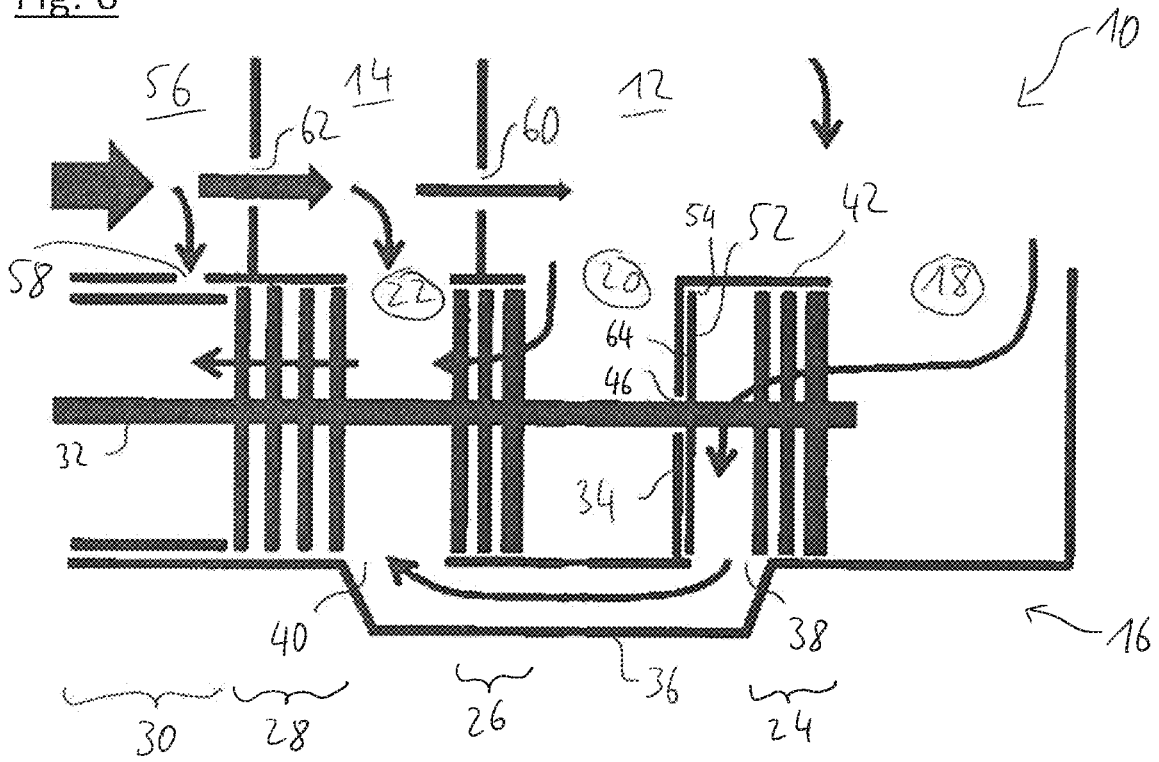
FIG. 6 shows another vacuum system in accordance with the invention having two blocking walls.

In FIG. 6, there is shown another vacuum system 10 having a plurality of vacuum chambers, namely a first vacuum chamber 12, a second vacuum chamber 14 and a third vacuum chamber 56. The vacuum chambers are connected to associated inlets of a vacuum pump 16. In particular, the first vacuum chamber 12 is connected to first and second inlets 18, 20, the second vacuum chamber 14 is connected to a third inlet 22, and the third vacuum chamber 56 is connected to a fourth inlet 58 of the vacuum pump 16.

The vacuum pump 16 comprises four pumping stages 24, 26, 28, 30 each connected to and associated with a respective inlet 18, 20, 22, 58 and each effecting a pumping action from the respective inlet towards the common outlet (not shown), as indicated by the arrows extending through the pump 16.

During operation of the vacuum system 10, there will develop different pressure levels, i.e. different vacuum levels, in the vacuum chambers 12, 14, and 56, as their respective inlets are connected to successive pumping stages. The first and second inlets 18, 20 are connected to equally ranking pumping stages 24 and 26, as regards inlet pressure. The third inlet 22 is connected to the third pumping stage 28, which succeeds—i.e. is arranged downstream of—the first and second pumping stages 24, 26. Thus, the pressure at the third inlet 22 is generally higher. Similarly, the fourth inlet 58 is connected to the fourth pumping stage 30, which succeeds the third pumping stage 28. Thus, the pressure at the fourth inlet 58 is higher than at the third inlet 22.

The chambers 12, 14, 56 are connected to the neighboring ones by means of two orifices 60, 62 of different sizes, as indicated by the arrows of different sizes extending therethrough and representing a gas stream. The orifices 60, 62 are small in relation to the pumping speed of the respective pumping stages, such that different vacuum levels still develop in the respective chambers 12, 14, 56.

There are a couple of further optional refinements to point out. The pump 16 comprises a static blocking wall 34. It is generally difficult to completely seal the blocking wall 34 to the rotor shaft 32 since the shaft 32 is spinning and needs some clearance for shock and vibration. The blocking wall 34 may be made in two halves to facilitate installation and these halves have to seal together at least in a molecular flow sense. A snout and/or sleeve can be added, which wraps around the shaft 32 as long as an appropriate clearance can be maintained. An optional improvement to reduce the leakage through the blocking wall 34 is to add an additional blocking wall 52, which is arranged on the rotor shaft 32 and in close axial proximity to the static blocking wall 34. The rotor blocking wall 52 is embodied as a spinning flat plate attached to the shaft 32.

This arrangement provides for an axial gap 64 between the blocking walls 34 and 52, which has a relatively long radial extension and, thus, a relatively long sealing length, which even adds to the sealing length of the radial gaps 46 and 54. As a further benefit, gas molecules in the small axial gap 64 between the surfaces tend to hit the spinning disc, i.e. the blocking wall 52, and are flung outward. This further reduces the leakage from the downstream end of the first pumping stage 24 to the second inlet 20.

In the embodiment of FIG. 6, the conduit inlet 38 and the rotor blocking wall 52 are arranged such that the conduit inlet 38 is open to a radial end of the blocking wall 52. Gas molecules striking the radial end of the blocking wall 52 receive a tangential vector which increases the pumping toward the conduit. Thus, pumping speed is further improved.

Another optional refinement is exposing the radial end at least of the last rotor element of the first pumping stage to the conduit inlet 38, as shown. Normally, trying to pump "from the side" of a rotor has a negligible effect on pumping speed. That is because the molecules are flung back out into the chamber, which is to be evacuated. In the case of the conduit, however, it is aimed for pumping molecules radially and then parallel to the axis and the tangential vector helps instead of hurts. Considering the cosine distribution of molecules leaving a surface, it might be generally advantageous to add an angled surface to the conduit inlet, in particular across from an exposed rotating element, a turbo rotor element in this example, to deflect the molecules down the conduit.

In general, a blocking wall may be essentially designed like rotor or stator elements of turbomolecular pumping stages, except that the blocking wall lacks turbo vanes. In particular, the blocking wall may be fixed to a static element, such as the housing, or to the rotor in a manner known from rotor or stator elements. For example, a static blocking wall may be positioned by means of spacing rings disposed at an inner surface of a housing and between neighboring static elements. A blocking wall arranged on the rotor may be formed as an integral part of a one-piece rotor or may be formed as a disc mounted on a rotor shaft, just like known turbo rotor elements.

Figure 7:
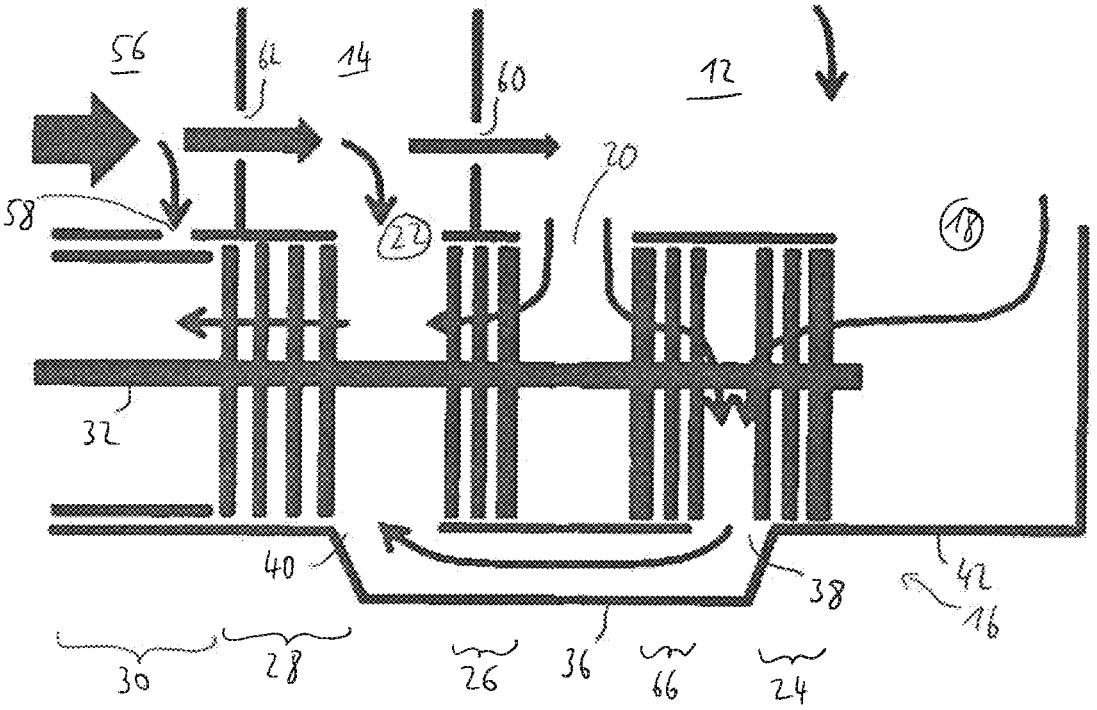
FIG. 7 depicts another vacuum system in accordance with the invention comprising a reverse pumping stage.

In FIG. 7, a further embodiment of a vacuum system is shown as being essentially designed like the one of FIG. 6, except that the pump 16 comprises a reverse pumping stage 66 serving as a direction element and preventing a gas flow from the downstream end of the first pumping stage 24 to the second inlet 20 and the upstream end of the second pumping stage 26.

The reverse pumping stage 66 comprises an opposingly arranged, in particular left-handed, set of rotor and stator elements. It causes a pumping action in an opposite geometrical direction as the first pumping stage 24 and gas streams of the two are united at the conduit inlet 38, as indicated in FIG. 7 by the corresponding arrows.

In this embodiment, the reverse pumping stage comprises three sets of rotor/stator pairs, although other numbers of rotors and stators are possible. The conduit inlet 38 is, in the present case, open to a radial end of a final rotor element of both the first and reverse pumping stages 24, 66.

In an embodiment, each of the first, second and reverse pumping stages 24, 26, and 66 comprises a pumping speed of about 300 L/s. At first glance one might think that 900 L/s could be achieved. However, with the practical limits of the shaft length, the conduit conductance may be limited by the size of the conduit inlet 38. Thus, the additional pumping action of the reverse pumping stage 66, preferably using an extra set of left-handed rotors and stators, might not actually achieve much improvement with respect to resulting pumping speed. However, the direction function of the reverse pumping stage might still be beneficial.

The conduction of the conduit 38 may generally be poor. For example, in the embodiments of FIGS. 6 and 7, the gas must make two 90 degree turns and travel the length of the second inlet and several rotor/stator pairs, and then make an additional two 90 degree turns before hitting the third pumping stage 28. However, if enough compression is provided upstream of the conduit 38, i.e. by the first pumping stage 24, then the throughput is quite sufficient to handle the compressed gas despite what appears to be a low conductance. In fact, the cross-section area of the conduit 38 does not need to be very large compared to the pump cross-section area, because of the compression. In nitrogen and water, two or three rotors may be sufficient for each path depending on implementation, because about two orders of magnitude of compression can be achieved. Often, the first rotor element of a pumping stage is a thicker high pumping speed and low compression rotor element. But higher compression rotor elements might allow just two rotor/stator pairs to be workable. Since achieving the necessary compression in a small number of rotor/stator pairs is difficult in helium and hydrogen, this invention may be difficult to implement in gas chromatography mass spectrometry (abbreviated as GC/MS), requiring more rotor/stator pairs and/or more shaft length. Preliminary analysis suggests that 1.5× pumping speed improvements are possible in LC/MS applications using known current motor, shaft, and bearing technology.

Generally, further inlets could be provided for connection to the first chamber 12. The further inlets preferably may be combined in the conduit or provided with separate conduits. This not only may further increase the pumping speed applied to the first chamber 12 but also makes for a distributed pump which has its pumping speed distributed along a long rectangle area rather than in a large circle. The advantages are significant. First, the pump can be run faster than a conventional turbo pump of the same pumping speed making it more space efficient and cheaper. Secondly, for linear systems such as are common in mass spectrometry, or other physically linear systems, the pump width would then continue to match the manifold. The manifold could enjoy the advantage of the higher pumping speed without having to switch to a more expensive larger manifold. In the case of systems with gas loads distributed along an axis, the inherent limitation of the manifold end-to-end conduction is relieved, because the gas is transported from the various inlets in a compressed form back to the final molecular and then viscous compression stages.

Although both FIGS. 6 and 7 show a third inlet 22 across from the conduit outlet 40, it would also be possible to have the conduit 38 reenter the pump before or after the third inlet 22 depending on the pressure of that third inlet 22. In some systems, there would be no need for this third inlet 22. Similarly, the fourth inlet 58 connected to the fourth pumping stage 30, which is a molecular drag stage in the present embodiment, of the pump 16 might not be needed in some systems. The figures show a single conduit 40. It could be arranged on the same side of the pump 16 as a controller, thus fitting into a volume that is often an empty space in a product. However, multiple parallel conduits are also possible. For example, four parallel conduits, one in each corner, could allow the pump to contain its own conduits within the confines of a rectangular extrusion, which is only a little larger than the rotor diameter.

Figure 8:
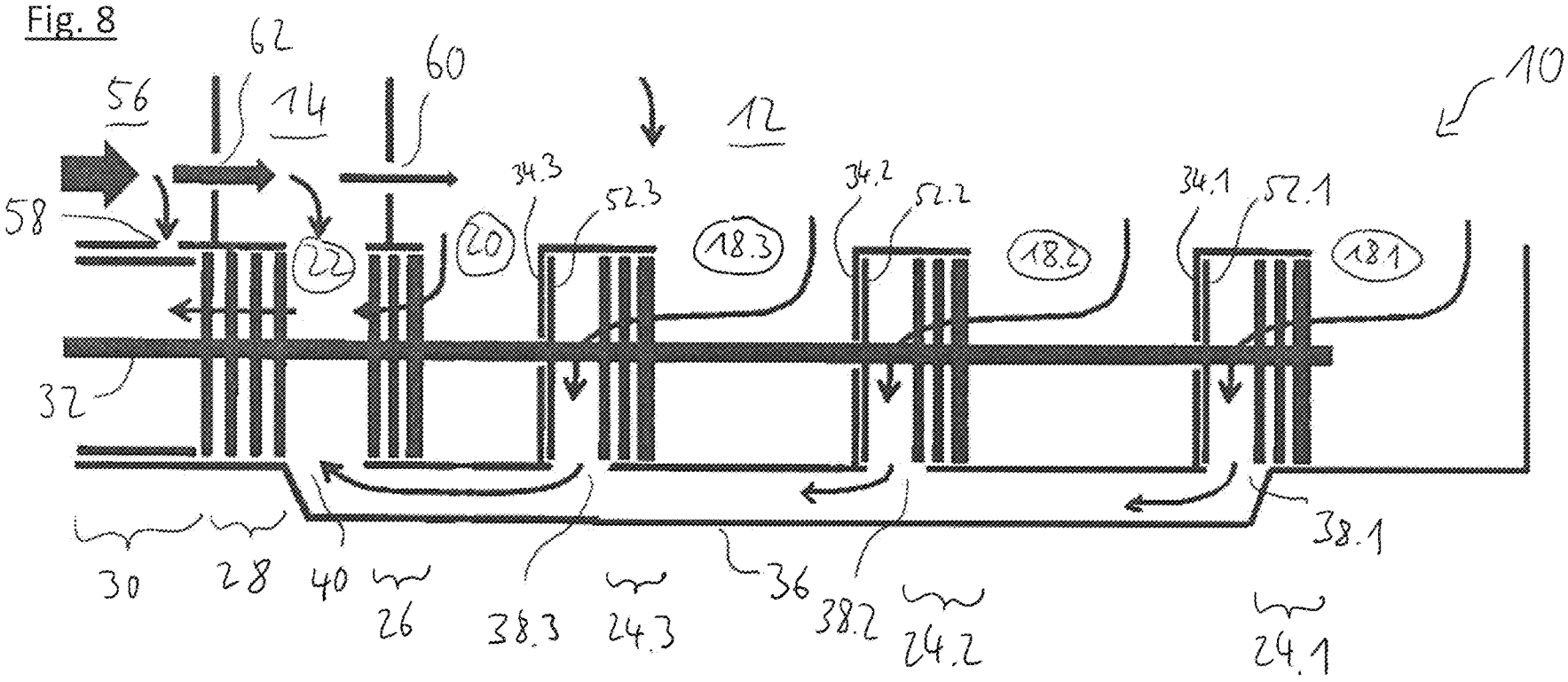
FIG. 8 shows another vacuum system in accordance with the invention comprising three first pumping stages.

FIG. 8 shows another vacuum system 10, which generally corresponds to the one shown in FIG. 6 except that the vacuum pump comprises three first pumping stages 24.1, 24.2 and 24.3 and three first inlets 18.1, 18.2 and 18.3 corresponding respectively thereto, i.e. the first inlet 18.1 is connected to the upstream end of the first pumping stage 24.1 and so forth as shown. The downstream ends of all first pumping stages 24.1, 24.2, 24.3 are connected to a location downstream of the second pumping stage 26 by means of a common conduit 36. The downstream ends of each first pumping stage 24.1, 24.2, 24.3 are separated from the second inlet and the first inlet 18.2, 18.3 of a respective neighboring first pumping stage 24 as well as from the upstream ends of stages 26, 24.2 and 24.3 by means of direction elements 34.1, 52.1, 34.2, 52.2, 34.3, 52.3. The first inlets 18 and the second inlet 20 are all connected to the same vacuum chamber 12. The first pumping stages 24 and the second pumping stage 26 operate in parallel mode. Generally, there may be any number of first pumping stages, in particular characterized in that their downstream ends are connected to a location downstream of the second pumping stage and separated from the second inlet or a neighboring first inlet, in particular by means of a direction element, in particular wherein the upstream ends of all first pumping stages are connected to the same vacuum chamber as the upstream end of the second pumping stage.

LIST OF REFERENCE NUMBERS

10 vacuum system
12 first vacuum chamber
14 second vacuum chamber
16 vacuum pump
18 first inlet
20 second inlet
22 third inlet
24 first pumping stage
26 second pumping stage
28 third pumping stage

30 fourth pumping stage
32 rotor shaft
34 blocking wall
36 conduit
38 conduit inlet
40 conduit outlet
42 housing
44 pair of rotor/stator elements
46 radial gap
48 sleeve
50 gas stream
52 blocking wall
54 radial gap
56 third vacuum chamber
58 fourth inlet
60 orifice
62 orifice
64 axial gap
66 reverse pumping stage

What is claimed is:

1. A vacuum system comprising a vacuum pump and at least one vacuum chamber, wherein the vacuum pump comprises:

at least a first and a second inlet and a common outlet;

at least a first and a second pumping stage, each pumping stage comprising at least one rotor element being arranged on a common rotor shaft, wherein the first inlet is connected to an upstream end of the first pumping stage and the second inlet is connected to an upstream end of the second pumping stage;

a direction element for preventing a gas flow from a downstream end of the first pumping stage to the second inlet;

a conduit having a conduit inlet and a conduit outlet, wherein the conduit inlet is connected to the downstream end of the first pumping stage and the conduit outlet is connected to a location downstream of the second pumping stage;

wherein the first inlet and the second inlet of the pump are connected to the same vacuum chamber;

wherein the direction element comprises a static block wall and a blocking wall that is arranged on the rotor shaft, wherein the blocking wall on the rotor shaft and the static blocking wall are arranged in close axial proximity to each other.

2. The vacuum system according to claim 1, wherein both pumping stages define respective gas streams which are separate from each other and flow in parallel mode upstream of the location to which the conduit outlet is connected.

3. The vacuum system according to claim 1, wherein the pump comprises a third pumping stage, wherein the downstream end of the second pumping stage and/or the conduit outlet are connected to an upstream end of the third pumping stage.

4. The vacuum system according to claim 1, wherein the pump comprises a third inlet connected to the upstream end of a third pumping stage, the conduit outlet and/or the downstream end of the second pumping stage, wherein the third inlet is connected to a second vacuum chamber.

5. The vacuum system according to claim 1, wherein the direction element comprises at least one blocking wall.

6. The vacuum system according to claim 5, wherein the blocking wall comprises a disc.

7. The vacuum system according to claim 1, wherein the direction element defines a gap between a rotating part and a static part, the gap having an elongate extension.

8. The vacuum system according to claim 1, wherein the direction element comprises a reverse pumping stage, effecting a gas flow from the second inlet to the conduit inlet and/or to the downstream end of the first pumping stage.

9. The vacuum system according to claim 8, wherein the reverse pumping stage comprises a rotor element which is arranged on the common rotor shaft.

10. The vacuum system according to claim 8, wherein the reverse pumping stage comprises a pumping direction which is opposite a pumping direction of the first and/or second pumping stage.

11. The vacuum system according to claim 1, wherein the conduit inlet and a rotating element arranged on the rotor shaft are arranged such that the conduit inlet is open to a radial end of the rotating element.

12. The vacuum system according to claim 1, wherein the vacuum pump comprises at least two first pumping stages and at least two first inlets corresponding respectively thereto, the downstream ends of all first pumping stages being connected to a location downstream of the second pumping stage and being separated from the second inlet and/or the first inlet of a neighboring first pumping stage.

13. The vacuum system according to claim 1, wherein the vacuum chamber is part of a mass spectrometry and/or chromatography system.

14. A method of using the vacuum pump of claim 1 to evacuate the at least one vacuum chamber, the method comprising the step of:

bypassing the second pumping stage and/or the second inlet via the conduit.

15. A vacuum system comprising a vacuum pump and at least one vacuum chamber, wherein the vacuum pump comprises: at least a first and a second inlet and a common outlet; at least a first and a second pumping stage, each pumping stage comprising at least one rotor element being arranged on a common, rotor shaft, wherein the first inlet is connected to an upstream end of the first pumping stage and the second inlet is connected to an upstream end of the second pumping stage; a Holweck pumping stage arranged on the common rotor shaft downstream of the at least first and second pumping stages; a direction element for preventing a gas flow from a downstream end of the first pumping stage to the second inlet; a conduit having a conduit inlet and a conduit outlet, wherein the conduit inlet is connected to the downstream end of the first pumping stage and the conduit outlet is connected to a location downstream of the second pumping stage; wherein the first inlet and the second inlet of the pump are connected to the same Vacuum chamber; wherein the direction element comprises a blocking wall which is arranged on the rotor shaft.

16. A method of using the vacuum pump of claim 15 to evacuate the at least one vacuum chamber, the method comprising the step of bypassing the second pumping stage and/or the second inlet via the conduit.

17. A vacuum system, the vacuum comprising a vacuum pump and at least one vacuum chamber, wherein the vacuum pump comprises: at least a first and a second inlet and a common outlet; at least a first and a second pumping stage, each pumping stage comprising at least one rotor element being arranged on a common rotor shaft, wherein the first inlet is connected to an upstream end of the first pumping stage and the second inlet is connected to an upstream end of the second pumping stage; a Holweck pumping stage arranged on the common rotor shaft downstream of the at least first and second pumping stages; a direction element for preventing a gas flow from a downstream end of the first pumping stage to the second inlet; a conduit having a conduit inlet and a conduit outlet, wherein the conduit inlet is connected to the downstream end of the first pumping stage and the conduit outlet is connected to a location downstream of the second pumping stage; wherein the first inlet and the second inlet of the pump are connected to the same vacuum chamber; wherein the direction element comprises a static blocking wall and a blocking wall which is arranged on the rotor shaft.

18. A method of using the vacuum pump of claim 17 to evacuate the at least one vacuum chamber, the method comprising the step of bypassing the second pumping stage and/or the second inlet via the conduit.

* * * * *